US008556094B2

(12) United States Patent
Brown et al.

(10) Patent No.: US 8,556,094 B2
(45) Date of Patent: Oct. 15, 2013

(54) BABY BOTTLE HAVING COMPARTMENTED CLOSURE FOR SELECTIVELY MIXING AND DISPENSING BABY FORMULA

(76) Inventors: Jeddah B Brown, Ipswitch (AU); Jessica Rimene, Ipswitch (AU); Delwyn Hawk, Ipswitch (AU)

( * ) Notice: Subject to any disclaimer, the term of this patent is extended or adjusted under 35 U.S.C. 154(b) by 1 day.

(21) Appl. No.: 13/445,913

(22) Filed: Apr. 13, 2012

(65) Prior Publication Data

US 2012/0193317 A1 Aug. 2, 2012

(51) Int. Cl.

| | |
|---|---|
| ***A61J 9/00*** | (2006.01) |
| ***B65D 1/04*** | (2006.01) |
| ***B65D 81/32*** | (2006.01) |
| ***B65D 23/04*** | (2006.01) |
| ***B65D 25/08*** | (2006.01) |

(52) U.S. Cl.

USPC ..... 215/11.4; 215/6; 215/11.1; 215/11.6; 215/227; 215/228; 215/310; 215/313; 215/314; 215/321; 215/DIG. 8; 220/502; 206/219; 206/221; 426/117

(58) Field of Classification Search

USPC ..... 206/219–222; 215/6, 11.1, 11.4–11.6, 215/227, 228, 277, 307–311, 313, 314, 321, 215/DIG. 8; 220/502; 426/117

See application file for complete search history.

(56) References Cited

U.S. PATENT DOCUMENTS

| | | | | |
|---|---|---|---|---|
| 1,667,818 | A * | 5/1928 | Page | 222/144.5 |
| 1,896,976 | A * | 2/1933 | Schifferdecker | 220/253 |
| 2,885,104 | A | 5/1959 | Greenspan | |
| 3,144,152 | A * | 8/1964 | Kopp | 215/6 |
| 4,779,722 | A * | 10/1988 | Hall | 206/221 |
| 4,856,995 | A * | 8/1989 | Wagner | 433/215 |
| 4,979,629 | A * | 12/1990 | Askerneese | 215/11.1 |
| 5,419,445 | A | 5/1995 | Kaesemeyer | |
| 5,433,328 | A | 7/1995 | Baron et al. | |
| 5,588,561 | A * | 12/1996 | Ness | 222/129 |
| 5,593,052 | A * | 1/1997 | McGee | 215/11.1 |
| D387,171 | S | 12/1997 | Johnson | |
| 5,758,786 | A * | 6/1998 | John | 215/6 |
| 5,921,440 | A * | 7/1999 | Maines | 222/145.2 |
| 6,257,428 | B1 | 7/2001 | Caola | |
| 6,446,822 | B1 * | 9/2002 | Meyers et al. | 215/11.5 |
| D478,993 | S | 8/2003 | Mitchell et al. | |
| 6,601,720 | B2 * | 8/2003 | Meyers et al. | 215/11.5 |
| 6,820,767 | B2 * | 11/2004 | Nicholas | 222/144.5 |
| 7,036,975 | B2 | 5/2006 | Renz | |
| D532,298 | S * | 11/2006 | Vogel | D9/447 |
| 7,331,478 | B2 | 2/2008 | Aljadi | |
| 7,484,633 | B1 * | 2/2009 | Moher | 215/11.1 |
| 7,810,661 | B2 * | 10/2010 | Murphy | 215/11.1 |
| 7,850,027 | B2 * | 12/2010 | Hayes et al. | 215/11.4 |

(Continued)

*Primary Examiner* — J. Gregory Pickett
*Assistant Examiner* — Ned A Walker

(57) ABSTRACT

A baby formula delivery assembly includes a container that has a bottom wall, a top wall, and a perimeter wall extending between the top and bottom walls. A housing has an upper wall and a peripheral wall that is attached to and extends downwardly from the upper wall. The peripheral wall extends downwardly around the container adjacent to the top wall and is rotatably and non-removably coupled to the container. A lower wall is attached to the peripheral and is spaced from the upper wall and defines an interior space of the housing. The lower wall has a second powder aperture extending therethrough. A nipple is attached to the upper wall and is in fluid communication with the interior space of the housing. A quantity of water is positioned within the container. A quantity of baby formula is positioned within the housing.

2 Claims, 4 Drawing Sheets

(56) References Cited

U.S. PATENT DOCUMENTS

| | | | | |
|---|---|---|---|---|
| 8,123,057 | B2 * | 2/2012 | Kunz et al. | 215/216 |
| 2007/0017890 | A1 * | 1/2007 | Al-Jadh | 215/11.1 |
| 2007/0278174 | A1 * | 12/2007 | Kunz et al. | 215/224 |
| 2008/0156763 | A1 | 7/2008 | Murphy | |
| 2009/0178940 | A1 * | 7/2009 | Said | 206/221 |
| 2011/0120900 | A1 * | 5/2011 | Nahum | 206/524.1 |

* cited by examiner

BABY BOTTLE HAVING COMPARTMENTED CLOSURE FOR SELECTIVELY MIXING AND DISPENSING BABY FORMULA

BACKGROUND OF THE DISCLOSURE

Field of the Disclosure

The disclosure relates to baby formula delivery devices and more particularly pertains to a new baby formula delivery device for storing and allowing selective mixing of baby formula and water.

SUMMARY OF THE DISCLOSURE

An embodiment of the disclosure meets the needs presented above by generally comprising a container that has a bottom wall, a top wall, and a perimeter wall extending between the top and bottom walls. The perimeter wall includes an inner surface and an outer surface. The top wall has a first powder aperture extending therethrough to access an interior of the container. A housing has an upper wall and a peripheral wall that is attached to and extends downwardly from the upper wall. The peripheral wall extends downwardly around the container adjacent to the top wall and is rotatably and non-removably coupled to the container. A lower wall is attached to the peripheral and is spaced from the upper wall and defines an interior space of the housing. The lower wall is positioned between the top wall and the upper wall. The lower wall has a second powder aperture extending therethrough. The second powder aperture is positionable in an aligned position with the first powder aperture to fluidly couple the interior space of the housing with an interior space of the container or in an unaligned position sealing the interior space of the housing from the interior space of the container. A nipple is attached to the upper wall and is in fluid communication with the interior space of the housing. A quantity of water is positioned within the container. A quantity of baby formula is positioned within the housing.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
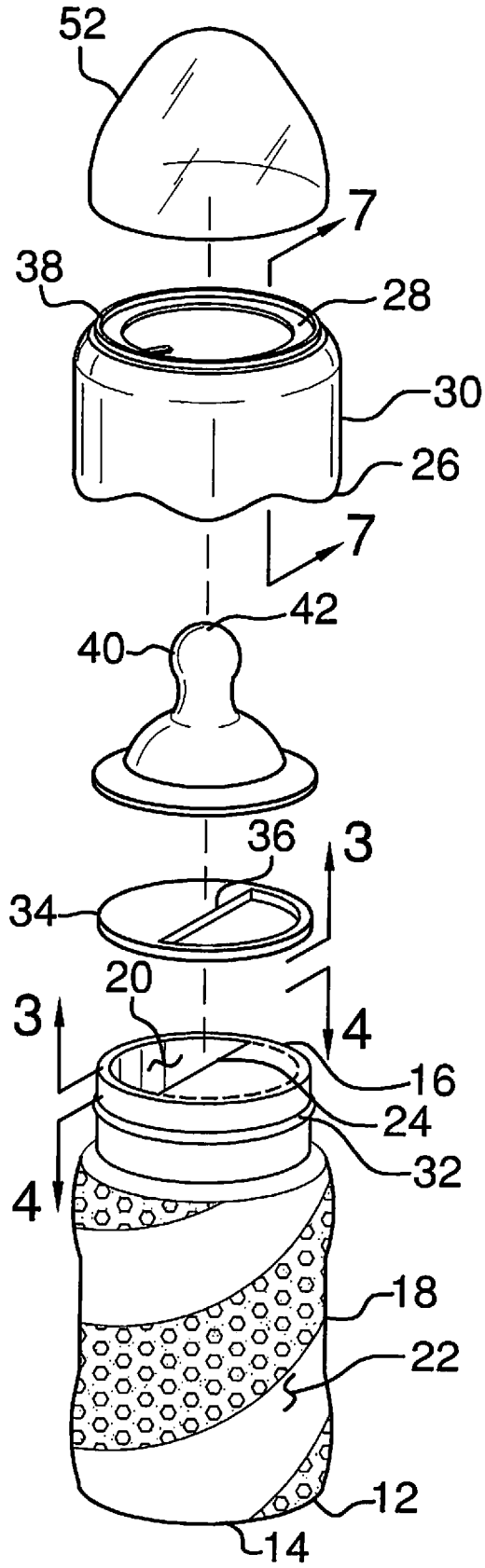
FIG. 1 is a side exploded view of a baby formula delivery assembly according to an embodiment of the disclosure.
Figure 2:
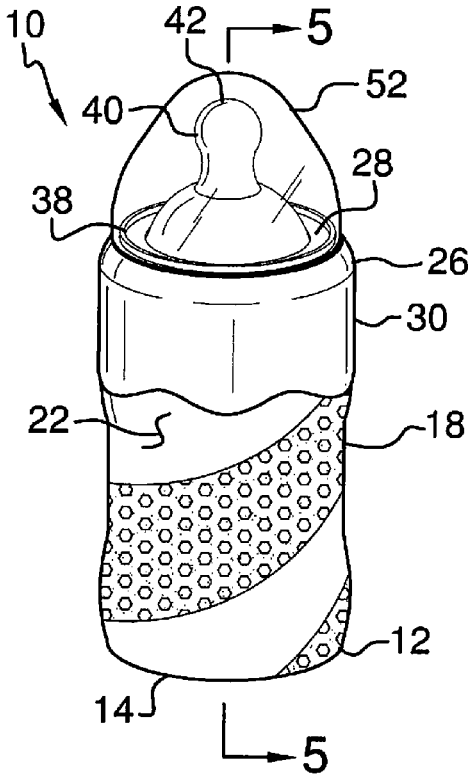
FIG. 2 is a side view of an embodiment of the disclosure.
Figure 3:
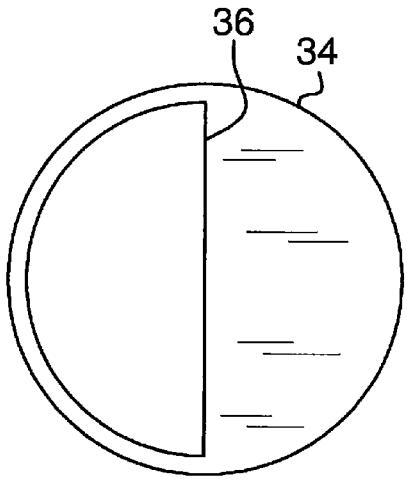
FIG. 3 is top view of lower wall of an embodiment of the disclosure.
Figure 4:
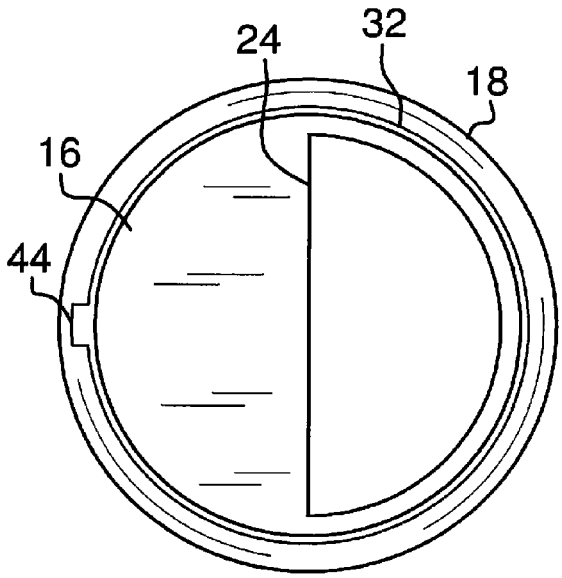
FIG. 4 is top view of a container of an embodiment of the disclosure.
Figure 5:
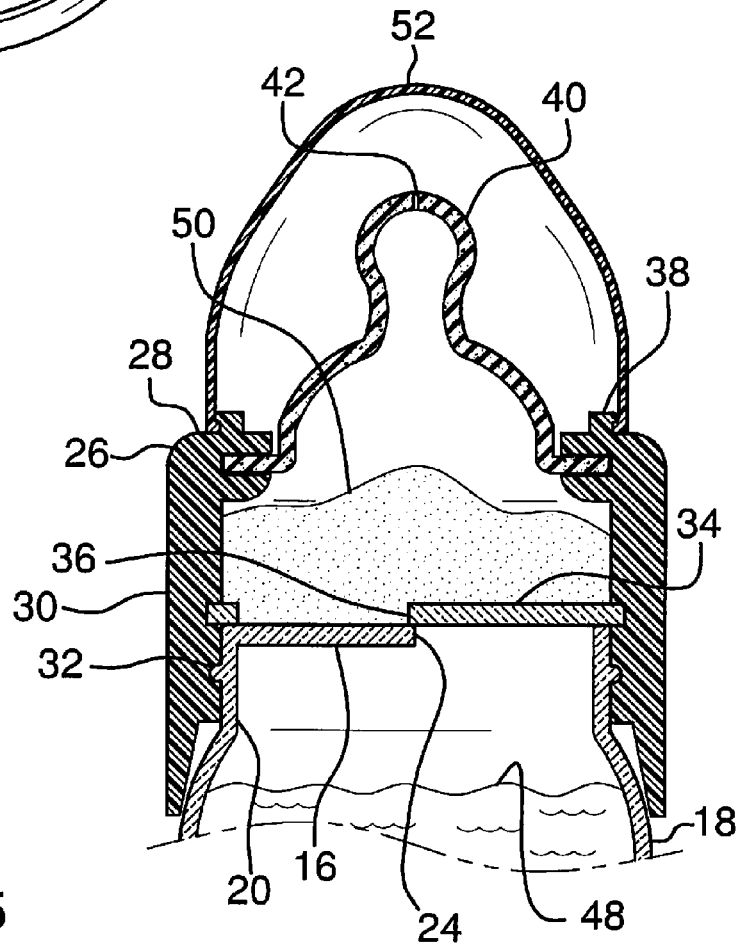
FIG. 5 is a cross sectional view taken along line 5-5 of FIG. 2 of an embodiment of the disclosure.
Figure 6:
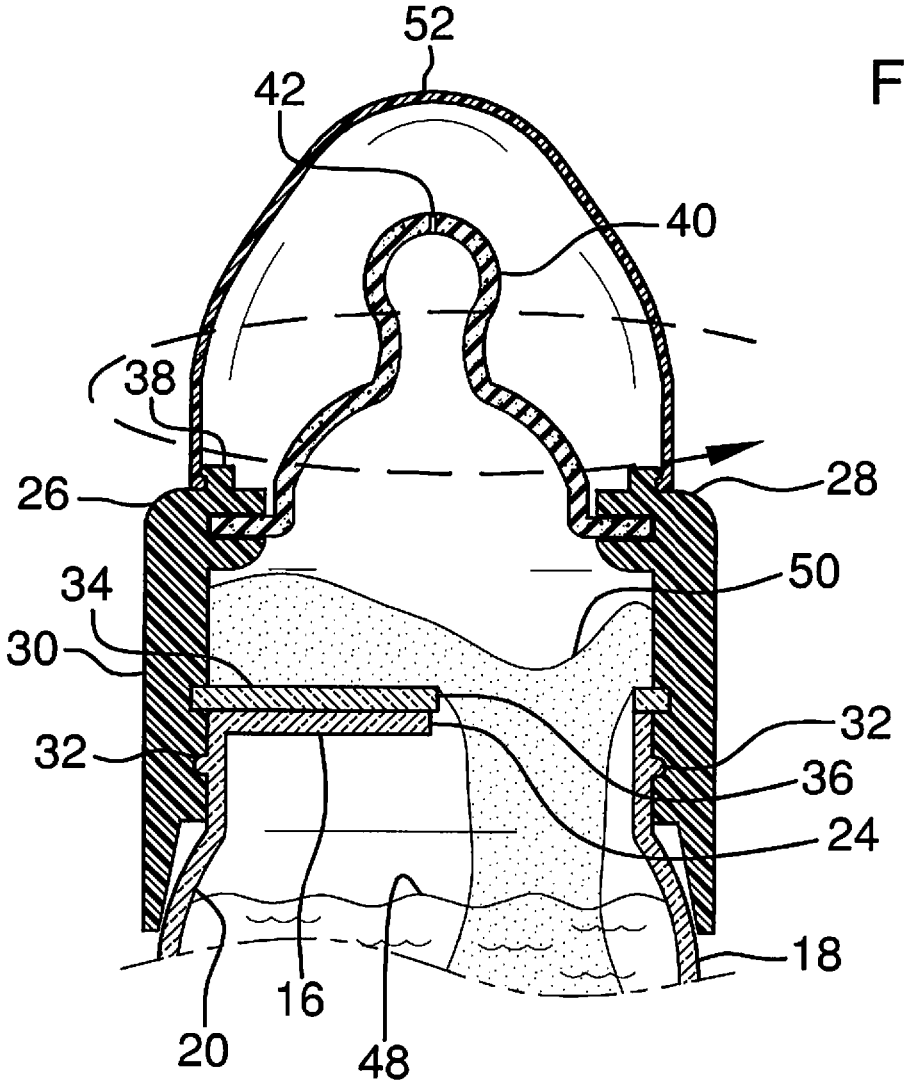
FIG. 6 is a cross sectional view taken along line 5-5 of FIG. 2 of an embodiment of the disclosure.
Figure 7:
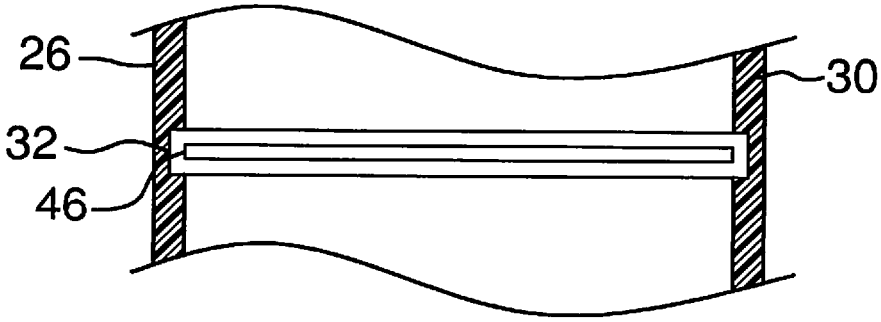
FIG. 7 is a cross sectional view of a housing taken along line 7-7 of FIG. 1 of an embodiment of the disclosure.

With reference now to the drawings, and in particular to FIGS. 1 through 7 thereof, a new baby formula delivery device embodying the principles and concepts of an embodiment of the disclosure and generally designated by the reference numeral 10 will be described.

As best illustrated in FIGS. 1 through 7, the baby formula delivery assembly 10 generally comprises a container 12 that has a bottom wall 14, a top wall 16, and a perimeter wall 18 extending between the top 16 and bottom walls 14. The perimeter wall 18 includes an inner surface 20 and an outer surface 22. The outer surface 22 is textured for facilitating gripping of the container 12. The top wall 16 has a first powder aperture 24 extending therethrough to access an interior of the container 12 and the first powder aperture 24 is spaced from a center of the top wall 16. The container 12 may be comprised of a rigid material such as plastic or other similar material.

A housing 26 has an upper wall 28 and a peripheral wall 30 that is attached to and extends downwardly from the upper wall 28. The peripheral wall 30 extends downwardly around the container 12 adjacent to the top wall 16 and is rotatably and non-removably coupled to the container 12. The perimeter wall 18 and the peripheral wall 30 include mating members 32 to retain the housing 26 on the container 12. A lower wall 34 is attached to the peripheral wall 30 and is spaced from the upper wall 28 to define an interior space of the housing 26. The lower wall 34 is positioned between the top wall 16 and the upper wall 28. The lower wall 34 has a second powder aperture 36 extending therethrough and the second powder aperture 36 is spaced from a center of the lower wall 34. The second powder aperture 36 is positionable in an aligned position with the first powder aperture 24 to fluidly couple the interior space of the housing 26 with an interior space of the container 12 or in an unaligned position sealing the interior space of the housing 26 from the interior space of the container 12. The upper wall 28 has a flange 38 attached thereto. The housing 26 may be comprised of a rigid material such as plastic or other similar material.

A nipple 40 is attached to the upper wall 28 and is in fluid communication with the interior space of the housing 26. The nipple 40 includes a cut 42 positioned on an upper end of the nipple 40. The nipple 40 is generally conventional and is configured to be sucked on by an infant to draw the formula and water mixture out of the cut 42. The nipple 40 may be comprised of a resiliently stretchable material such as rubber, latex, or other similar material.

A stop 44 is in mechanical communication with the housing 26 and restricts over rotation of the lower wall 34 beyond the aligned position. The stop 44 is mounted on and extends outwardly from the perimeter wall 18 and extends into a groove 46 in the peripheral wall 30 that extends no more than half of a circumference of the peripheral wall 30. The stop 44 is positioned to extend into the groove 46 and the stop 44 is configured to abut against each end of the groove 46 to restrict rotation of the housing 26 in each direction. The stop 44 may be positioned on mating member 32.

A quantity of water 48 is positioned within the container 12 and a quantity of baby formula 50 is positioned within the housing 26. The housing 26 is configured to be rotated such that the second powder aperture 36 is positioned in the aligned position with the first powder aperture 24 to allow mixing of the baby formula 50 and the water 48. A cover 52 is removably attached to the housing 26 and frictionally engages the flange 38 to cover the nipple 42. The cover 52 may be comprised of a rigid material such as plastic or other similar material.

In use, the housing 26 may be rotated to align the first 24 and second 36 powder apertures. The baby formula 50 may be mixed with the water 48. The mixture of water 48 and formula 50 may be consumed by an infant by having the infant suck on the nipple 42. The assembly 10 may be discarded after the mixture of water 48 and formula 50 is consumed.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A bottle for mixing and dispensing baby formula, said bottle comprising:

a container comprising:

a closed bottom wall;

an upper outlet end defined by a semicircular mouth disposed between a semiannular rim and a semicircular closed top wall;

an upper neck finish having a circumferential wall with an exterior fastening member, said circumferential wall extending downwardly from said semiannular rim and said semicircular closed top wall;

a cylindrical sidewall extending between said closed bottom wall and said upper neck finish to define a container interior for holding water;

a closure assembly comprising:

a rotatable disk abutting said upper outlet end of said container, said rotatable disk comprising:

a semicircular closed top;

a semiannular ring extending outward from said semicircular closed top;

a semicircular opening disposed between said semicircular closed top and said semiannular ring;

a sleeve surrounding said upper neck finish, said sleeve comprising:

an upper annular flange;

an annular groove housing said rotatable disk;

an upper collar portion extending upward from said rotatable disk to define a closure cavity for housing baby formula;

a lower skirt portion extending downwardly from said rotatable disk, said lower skirt having a bottom flange abutting said cylindrical sidewall of said container and an interior fastening member secured to said exterior fastening member of said container;

a nipple secured to said upper annular flange of said sleeve of said closure assembly; and, a cover secured to said upper annular flange of said sleeve of said closure assembly.

2. A baby formula delivery assembly for storing and allowing selective mixing of baby formula and water, said assembly comprising:

a container having a closed bottom wall, a partially open top wall, and a perimeter wall extending between said top and bottom walls, said perimeter wall including an inner surface and a textured outer surface for gripping, said top wall having a first semicircular powder aperture fluidly communicating with an interior of said container, said first powder aperture being spaced from a center of said partially open top wall;

a housing having an upper annular rim with an interior flange and a peripheral wall extending downwardly from said upper wall to surround said partially open top wall of said container, a central portion of said peripheral wall having an annular groove, and said housing being rotatably and non-removably coupled to said container via mating members, a circular insert disposed within said annular groove of said peripheral wall and being spaced from said upper annular rim and defining an interior space of said housing, said circular insert having a second semicircular powder aperture, said second powder aperture being spaced from a center of said circular insert, said second powder aperture having:

an aligned position with said first powder aperture to fluidly couple said interior space of said housing with said interior of said container, and, an unaligned position sealing said interior space of said housing from said interior space of said container by staggering said first powder aperture with said second powder aperture;

a nipple attached to said interior flange and being in fluid communication with said interior space of said housing;

a stop being in mechanical communication with said housing and restricting over rotation of said circular insert beyond said aligned position;

a quantity of water being positioned within said container;

a quantity of baby formula being positioned within said housing; and, a cover being removably attached to said housing and covering said nipple.

* * * * *